US010894335B2

(12) United States Patent
Park

(10) Patent No.: US 10,894,335 B2
(45) Date of Patent: Jan. 19, 2021

(54) CUTTING APPARATUS

(71) Applicants: HYUNDAI MOTOR COMPANY, Seoul (KR); KIA MOTORS CORPORATION, Seoul (KR)

(72) Inventor: Hee Sang Park, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 503 days.

(21) Appl. No.: 15/820,985

(22) Filed: Nov. 22, 2017

(65) Prior Publication Data

US 2018/0264675 A1 Sep. 20, 2018

(30) Foreign Application Priority Data

Mar. 20, 2017 (KR) ..... 10-2017-0034712

(51) Int. Cl.
*B26D 7/08* (2006.01)
*B26D 5/12* (2006.01)
*B26D 7/26* (2006.01)

(52) U.S. Cl.
CPC ..... *B26D 7/08* (2013.01); *B26D 5/12* (2013.01); *B26D 7/2614* (2013.01)

(58) Field of Classification Search
CPC ..... B26D 5/12; B26D 7/08; B26D 7/2614; B26D 7/2621
USPC ..... 425/292, 293, 295, 298
See application file for complete search history.

(56) References Cited

U.S. PATENT DOCUMENTS 1,972,789 A * 9/1934 Newkirk ..... B26F 1/40 264/153
2,482,981 A * 9/1949 Kamrass ..... B32B 27/00 428/81
3,461,761 A * 8/1969 Mojonnier ..... B29C 51/445 83/140
3,525,279 A * 8/1970 Christian ..... B26F 3/06 83/171
4,051,754 A * 10/1977 Harcuba ..... B26D 7/10 83/124
4,104,349 A * 8/1978 Hillgenberg ..... B26F 1/40 264/153
4,142,848 A * 3/1979 Irwin ..... B29C 51/32 425/291
4,243,456 A * 1/1981 Cesano ..... B29C 51/082 156/214

(Continued)

FOREIGN PATENT DOCUMENTS

JP H10-278071 A 10/1998
KR 10-2014-0106006 A 9/2014

OTHER PUBLICATIONS

Office Action issued in corresponding Korean Patent Application No. 10-2017-0034712 dated Nov. 2, 2020, with English translation.

*Primary Examiner* — Seyed Masoud Malekzadeh
(74) *Attorney, Agent, or Firm* — Morgan, Lewis & Bockius LLP

(57) ABSTRACT

The present disclosure relates to a cutting apparatus including a jig having a seating jig on which a machining target is seated and a fixing jig matched with the seating jig to fix the machining target, a cutter configured to cut the machining target along reference scheduled cutting lines, a first carrier reciprocating to allow the fixing jig to match with the seating jig or to be spaced apart from the seating jig, and a cooler configured to cool the machining target down to a reference temperature.

12 Claims, 11 Drawing Sheets

(56) References Cited

U.S. PATENT DOCUMENTS

| | | | | | |
|---|---|---|---|---|---|
| 4,327,049 | A * | 4/1982 | Miller | B29C 44/569 | 264/138 |
| 4,409,178 | A * | 10/1983 | Ward | B29C 51/30 | 264/544 |
| 4,755,129 | A * | 7/1988 | Baker | B29C 51/32 | 264/160 |
| 4,785,695 | A * | 11/1988 | Riley | B23D 31/001 | 83/193 |
| 4,824,714 | A * | 4/1989 | Gest | B29C 43/52 | 156/222 |
| 4,940,557 | A * | 7/1990 | Kimura | B26D 3/02 | 264/151 |
| 5,135,381 | A * | 8/1992 | Evans | B29C 51/32 | 425/308 |
| 5,759,594 | A * | 6/1998 | Masui | B29C 51/145 | 425/510 |
| 6,098,426 | A * | 8/2000 | Anderson | C03B 9/12 | 425/292 |
| 8,685,300 | B2 * | 4/2014 | Bosch | A01G 9/021 | 264/163 |
| 2002/0078804 | A1 * | 6/2002 | Spengler | B26F 1/40 | 83/13 |
| 2007/0017331 | A1 * | 1/2007 | Kawai | B26D 7/10 | 83/13 |
| 2012/0056346 | A1 * | 3/2012 | Maurer | B29C 69/001 | 264/48 |
| 2012/0198797 | A1 * | 8/2012 | Spillner | B26F 1/40 | 53/477 |
| 2013/0273191 | A1 * | 10/2013 | Dooley | B29C 45/14262 | 425/292 |
| 2014/0374472 | A1 * | 12/2014 | Treccani | B29C 51/306 | 229/407 |
| 2015/0258739 | A1 * | 9/2015 | Meskin | B29C 69/001 | 264/163 |

* cited by examiner

CUTTING APPARATUS

CROSS-REFERENCE TO RELATED APPLICATION

This application is based on and claims the benefit of priority to Korean Patent Application No. 10-2017-0034712, filed on Mar. 20, 2017, in the Korean Intellectual Property Office, the disclosure of which is incorporated herein in its entirety by reference.

TECHNICAL FIELD

The present disclosure relates to a cutting apparatus.

BACKGROUND

In general, examples of an interior material for a vehicle include a door trim, a pillar trim, a trunk mat, a package trim, a head liner, and the like.

Such an interior material for a vehicle may include a hard base material and a soft skin material attached to the hard base material. Further, a process of manufacturing an interior material for a vehicle includes a process of injection-molding (insert-injection-molding) an interior material, a process of cooling the interior material to prevent deformation of the interior material, a process of trimming an edge of a skin material, a process of applying adhesive to the trimmed edge of the skin material, a process of drying the adhesive, and a process of bonding the edge of the skin material to a base material to surround an edge of the base material by the edge of the skin material.

However, in general, in the process of cooling the interior material, the injection-molded interior material is cooled inside an injection mold. However, when the interior material is cooled inside the injection mold, the interior material may not be injected molded while the interior material is cooled. Thus, the conventional process of manufacturing an interior material for a vehicle has a problem in that because it takes a long time to manufacture the interior material, productivity deteriorates.

SUMMARY

The present disclosure provides a cutting apparatus having an improved structure such that a cooling process and a cutting process for a machining target are simultaneously performed so that a time consumed for manufacturing the machining target may be reduced.

The technical objects of the present disclosure are not limited to the above-mentioned one, and the other unmentioned technical objects will become apparent to those skilled in the art from the following description.

In accordance with an aspect of the present disclosure, a cutting apparatus includes: a jig having a seating jig on which a machining target is seated and a fixing jig matched with the seating jig to fix the machining target; a cutter configured to cut the machining target along reference scheduled cutting lines; a first carrier reciprocating to allow the fixing jig to match with the seating jig or to be spaced apart from the seating jig; and a cooler configured to cool the machining target down to a reference temperature.

The fixing jig selectively may press a reference pressed area of the machining target such that first scheduled cutting lines of the machining target are exposed to the outside of the jig, and the cutter may have first cutters configured to cut the machining target along the first scheduled cutting lines.

The first carrier may include a mounting plate on which the fixing jig and the first cutters are mounted, and a transfer cylinder reciprocating to allow the mounting plate to approach the machining target or to be spaced apart from the machining target.

The first carrier may further include elastic members connecting the jig and the mounting plate and elastically extending and contracting in a reciprocation direction of the fixing jig.

The elastic members may have a reference length such that the first cutters reach the first scheduled cutting lines after the fixing jig reaches the pressed area earlier.

The elastic members may have compression coil springs elastically extending and contracting in the reciprocation direction of the fixing jig.

The seating jig may include a first seating jig on which a portion of the machining target is seated, and a second seating jig on which another portion of the machining target is seated, the first seating jig and the second seating jig may be spaced apart from each other by a reference interval such that reference second scheduled cutting lines of the machining target are exposed to the outside of the jig through a space between the first seating jig and the second seating jig, and the cutter may include second cutters configured to cut the machining target along the second scheduled cutting lines.

The cutting apparatus may further include a second carrier reciprocating to allow the second cutters to approach the machining target or to be spaced apart from the machining target, through the space between the first seating jig and the second seating jig.

Preferably, the cooler may include a blower fan configured to blow air to the machining target through the space between the first seating jig and the second seating jig.

The cooler may cool at least one of the seating jig and the fixing jig to indirectly cool the machining target.

The cooler may include a blower fan configured to blow air to at least one of the seating jig and the fixing jig.

The cooler may have a cooling water passage formed in at least one of the seating jig and the fixing jig such that externally supplied cooling water flows through the cooling water passage.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
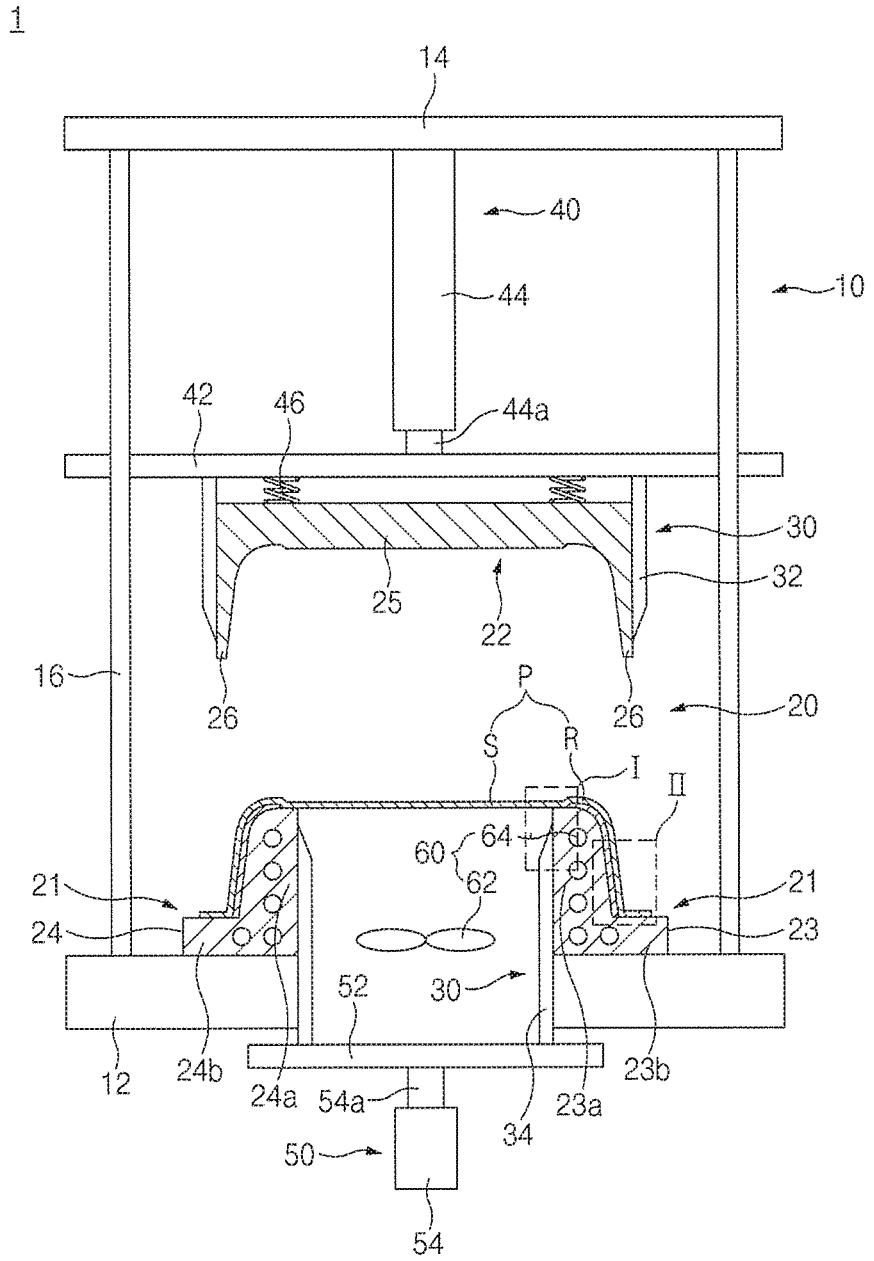
FIG. 1 is a schematic view illustrating a cutting apparatus according to an exemplary embodiment of the present disclosure.

Hereinafter, exemplary embodiments of the present disclosure will be described in detail with reference to the accompanying drawings. It should be noted that when components in the drawings are designated reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

In the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. Further, all terms used herein, including technical terms and scientific terms, may have the same meanings as those generally understood by those skilled in the art to which the present disclosure pertains as long as the terms are differently defined. The terms defined in a generally used dictionary should be interpreted to have the same meanings as those in the context of the related art, and are not interpreted as ideal or excessively formal meanings as long as the terms are not clearly defined in the present application.

Figure 2:
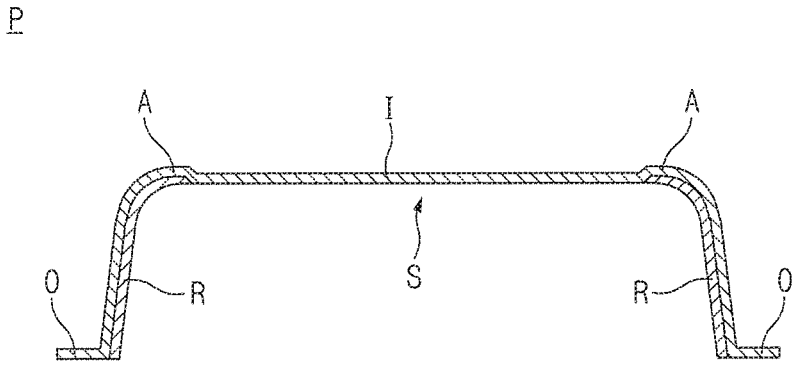
FIG. 2 is a view illustrating a machining target FIG. 1.
Figure 3:
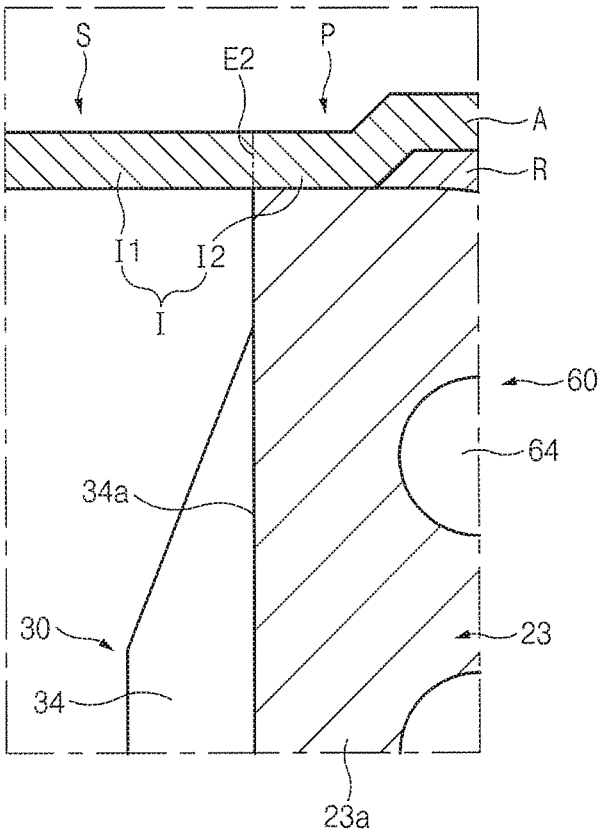
FIG. 3 is a partially enlarged view illustrating area of FIG. 1.
Figure 4:
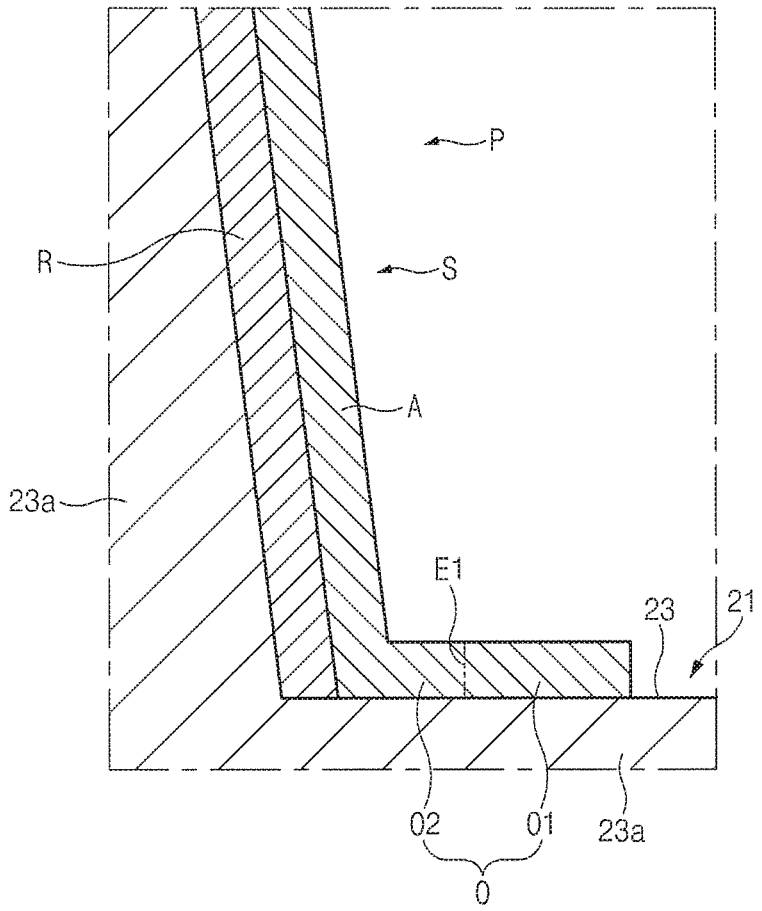
FIG. 4 is a partially enlarged view illustrating area II of FIG. 1.

FIG. 1 is a schematic view illustrating a cutting apparatus according to an exemplary embodiment of the present disclosure, FIG. 2 is a view illustrating a machining target of FIG. 1, FIG. 3 is a partially enlarged view illustrating area I of FIG. 1, and FIG. 4 is a partially enlarged view illustrating area II of FIG. 1.

A cutting apparatus according to an exemplary embodiment of the present disclosure may cut a machining target P and, at the same time, cool the machining target P. To achieve this, as illustrated in FIG. 1, the cutting apparatus 1 may include a main frame providing a support frame of the cutting apparatus 1, a jig unit 20 configured to fix or unfix the machining target P, a cutting unit 30 configured to cut the machining target P, a first transfer unit 40 and a second transfer unit 50 configured to transfer the jig unit 20 and the cutting unlit 30, and a cooling unit 60 configured to cool the machining target P.

The types of the machining target P that may be processed using the cutting apparatus 1 are not particularly limited. For example, as illustrated in FIG. 2, the machining target P may be a pillar trim for a vehicle, which includes a base material R and a skin material S attached to one surface of the base material R. Although such a machining target P may be insert-injection-molded by injecting raw material liquid for the base material to an injection mold after the pre-molded skin material S is inserted into the injection mold, the present disclosure is not limited thereto.

The number of the base materials R is not particularly limited. For example, as illustrated in FIG. 2, the machining target P may include a pair of base materials R. The skin material S may have a larger area than those of the base materials R to cover surfaces of the base materials R. As illustrated in FIG. 2, such a skin material S may include attachment parts A attached to the surfaces of the base materials R, outer edges O extending from the attachment parts A to surround outer sides of the attachment parts A, and an inner edge I extending from the attachment parts A to surround an inner side of the attachment parts A. Hereinafter, a case where the machining target P, which is withdrawn from the injection mold while being not cooled after being insert-injection-molded to have the above-described structure, is cut will be described as an example.

First, as illustrated in FIG. 1, a main frame 10 may include a lower plate 12, an upper plate 14 spaced upward apart from the lower plate 12 by a specific interval, and at least one support column 16 installed between the lower plate 12 and the upper plate 14 to support the upper plate 14. Such a main frame 10 may provide a support frame for installing various members included in the cutting apparatus 1.

Next, the jig unit 20 may include a seating jig 21 configured to seat the machining target P and a fixing jig 22 matched with the seating jig to fix the machining target P seated on the seating jig 21.

The seating jig 21 is provided such that at least a portion of the machining target P is seated thereon. For example, as illustrated in FIG. 1, the seating jig 21 may include a first seating jig 23 on which a portion of the machining target P is seated and a second seating jig 24 on which the other portion of the machining target P is seated.

As illustrated in FIG. 1, the first seating jig 23 and the second seating jig 24 may include first seating parts 23*a* and 24*a* on which the base materials R and the inner edge I are seated and second seating parts 23*b* and 24*b* on which the outer edges C) are seated, respectively. As illustrated in FIG. 3, the first seating parts 23*a* and 24*a* have a shape corresponding to lower surfaces of the base materials R and the inner edge I such that the lower surfaces of the base materials R and the inner edge I may be seated thereon. As illustrated in FIG. 4, the second seating parts 23*b* and 24*b* have a shape corresponding to lower surfaces of the outer edges O such that the lower surfaces of the outer edges O may be seated thereon.

As illustrated in FIGS. 1 and 3, the first seating jig 23 and the second seating jig 24 are spaced apart from each other such that an intermediate part I1 of the inner edge I is exposed to the jig unit 20 through a space between the first seating jig 23 and the second seating jig 24. To this end, as illustrated in FIG. 3, the first seating parts 23*a* and 24*a* may have a specific area such that an inner connector I2 connecting the attachment part A and the intermediate part I1 to each other is selectively seated.

Figure 5:
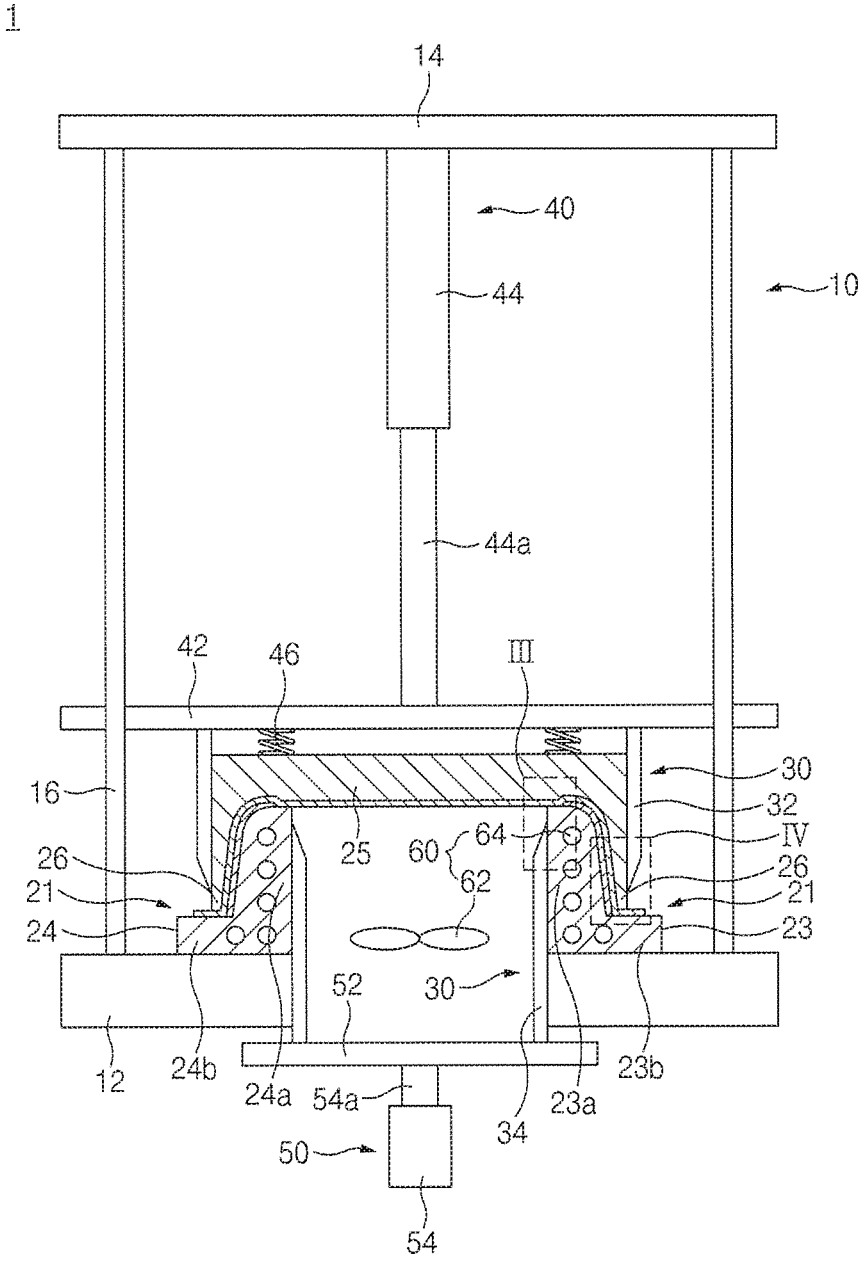
FIG. 5 is a view illustrating a state in which a jig unit of FIG. 1 fixes the machining target.
Figure 6:
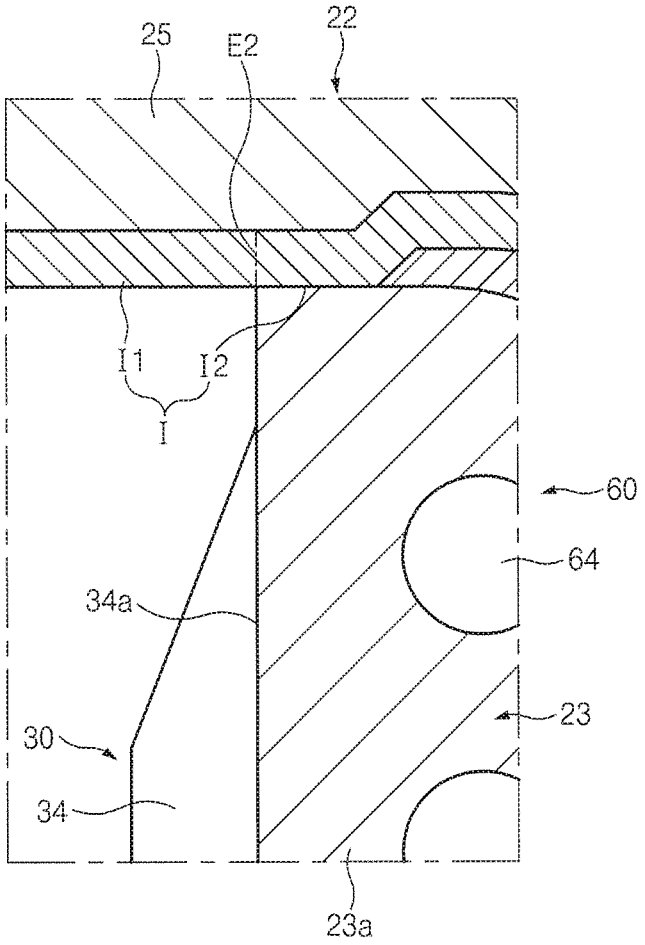
FIG. 6 is an enlarged view illustrating area III of FIG. 5.
Figure 7:
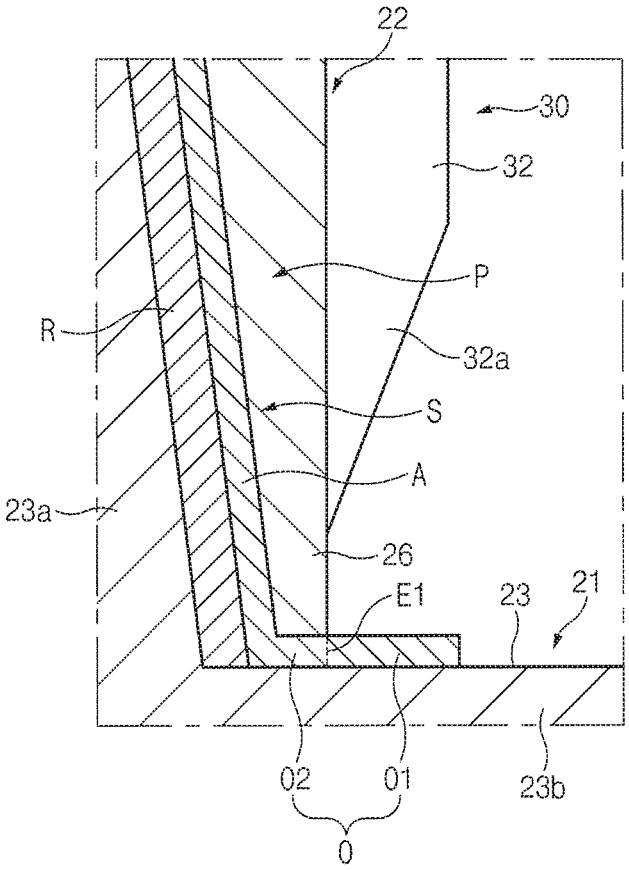
FIG. 7 is an enlarged view illustrating area IV of FIG. 5.

FIG. 5 is a view illustrating a state in which a jig unit of FIG. 1 fixes the machining target, FIG. 6 is an enlarged view illustrating area III of FIG. 5, and FIG. 7 is an enlarged view illustrating area IV of FIG. 5.

At least a portion of the fixing jig 22 is matched with the seating jig 21. For example, as illustrated in FIG. 5, the fixing jig 22 may include a first fixing part 25 matched with the first seating parts 23*a* and 24*a* and second fixing parts 26 matched with the second seating parts 23*b* and 24*b*.

As illustrated in FIG. 6, the first fixing part 25 has a shape corresponding to upper surfaces of the attachment parts A and the inner edge I to press the upper surfaces of the attachment parts A and the inner edge I.

As illustrated in FIG. 7, the second fixing parts 25 have a shape corresponding to upper surfaces of the outer edges O to press the upper surfaces of the outer edges O. In particular, as illustrated in FIG. 7, each of the second fixing parts 26 has a specific area such that outer ends O1 of the outer edges O are exposed to the outside of the jig unit 20. That is, the second fixing parts 26 may selectively press outer connectors O2 connecting the outer ends O1 of the outer edges O and the attachment parts A to each other.

As illustrated in FIG. 5, such a fixing jig 22 may be mounted on a first mounting member 42 of the first transfer unit 40, which will be described below, and may reciprocate to be matched with the seating jig 21 or spaced apart from the seating jig 21 by a first transfer member 44 of the first transfer unit 40, which will be described below. Thus, as illustrated in FIG. 5, when being transferred to be matched with the seating jig 21, the fixing jig 22 may press and fix the machining target P interposed between the seating jig 21 and the fixing jig 22. Further, as illustrated in FIG. 1, when being transferred to be spaced apart from the seating jig 21, the fixing jig 22 may unfix the machining target P.

Figure 8:
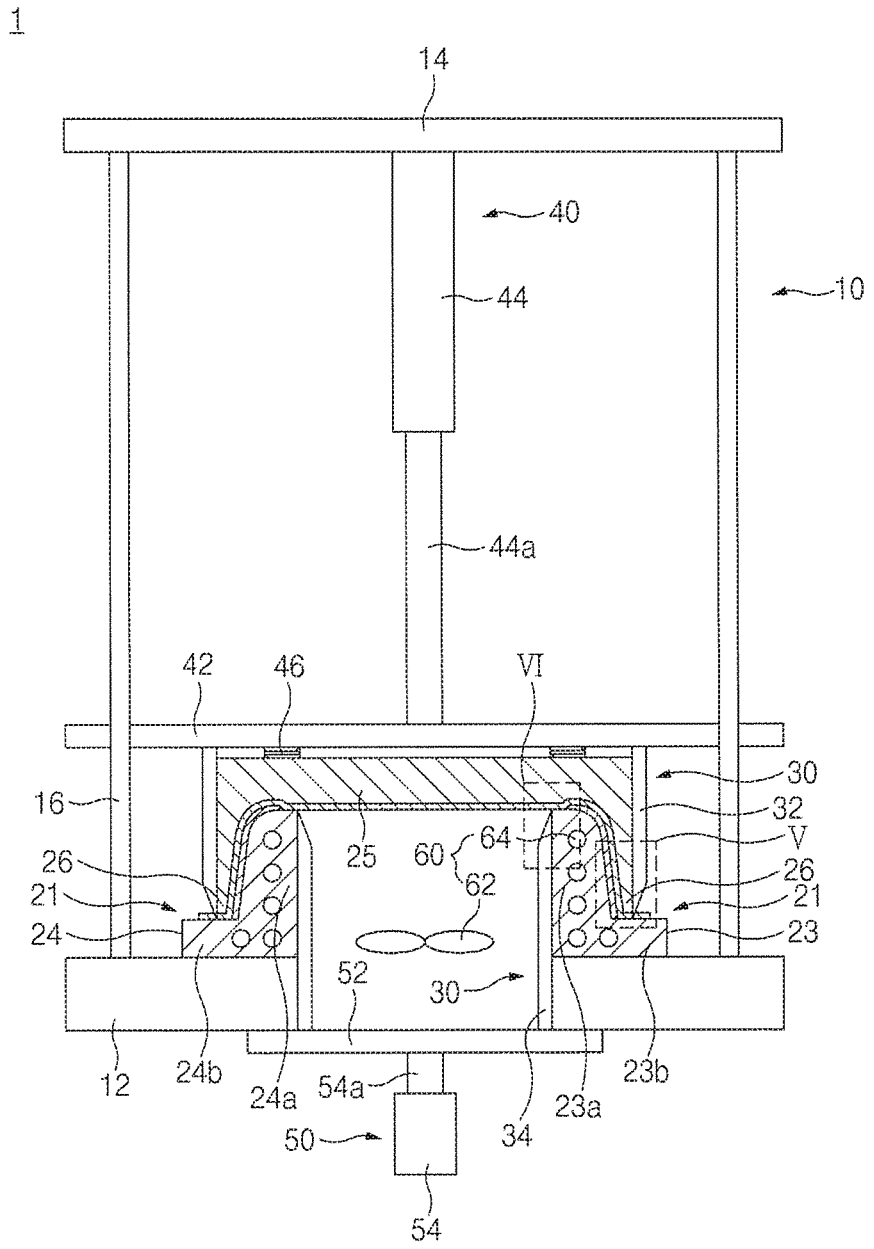
FIG. 8 is a view illustrating a cutter of FIG. 1 cuts the machining target.
Figure 9:
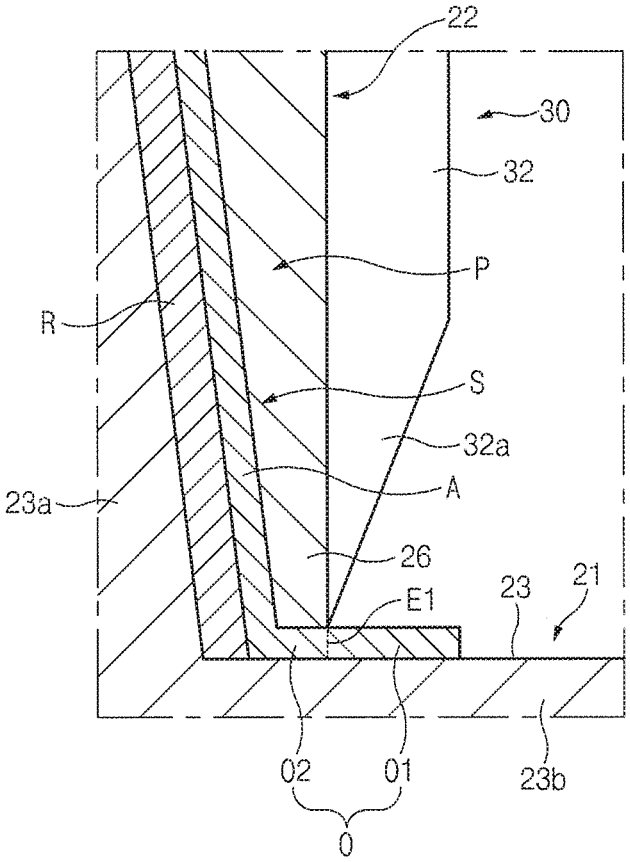
FIG. 9 is an enlarged view illustrating area V of FIG. 8.
Figure 10:
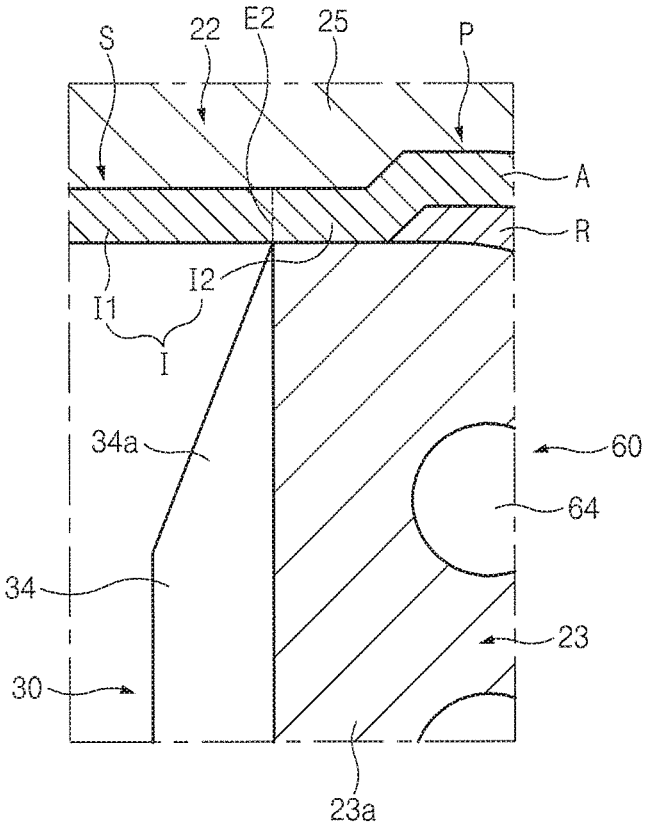
FIG. 10 is an enlarged view illustrating area VI of FIG. 8.

FIG. 8 is a view illustrating a cutting unit of FIG. 1 cuts the machining target, FIG. 9 is an enlarged view illustrating area V of FIG. 8, and FIG. 10 is an enlarged view illustrating area VI of FIG. 8.

Next, the cutting unit 30 may cut the machining target P along specific scheduled cutting lines E1 and E2. A structure of the cutting units 30 is not particularly limited. For example, as illustrated in FIG. 8, the cutting unit 30 may include first cutting members 32 configured to cut the machining target P along the specific first scheduled cutting lines E1 and second cutting members 34 configured to cut the machining target P along the specific second scheduled cutting lines E2.

The first scheduled cutting lines E1 refer to vertical lines set to cut the machining target P. Setting locations of the first scheduled cutting lines E1 are not particularly limited. For example, as illustrated in FIG. 7, the first scheduled cutting lines E1 are set along boundary lines between the outer ends O1 and the outer connectors O2 of the outer edges O.

As illustrated in FIGS. 5 and 7, the first cutting members 32 are cutters generally used to cut an injection product and are mounted on the first mounting member 42 of the first transfer unit 40, which will be described below, to face the first scheduled cutting lines E1.

As illustrated in FIG. 9, the first cutting members 32 may be transferred to the first scheduled cutting lines E1 by the first transfer unit 40 to cut the outer edges O of the skin material S along the first scheduled cutting lines E1.

The second scheduled cutting lines E2 refer to vertical lines set to cut the machining target P. Setting locations of the second scheduled cutting lines E2 are not particularly limited. For example, as illustrated in FIG. 6, the second scheduled cutting lines E2 are set along boundary lines between the intermediate part I1 and the inner connectors I2 of the inner edge I.

As illustrated in FIGS. 5 and 6, the second cutting members 34 are cutters generally used to cut an injection product and are mounted on a second mounting member 52 of the second transfer unit 50, which will be described below, to face the second scheduled cutting lines E2.

As illustrated in FIG. 10, such second cutting members 34 may be transferred to the second scheduled cutting lines E2 by the second transfer unit 50 to cut the skin material S along the second scheduled cutting lines E2.

Next, the first transfer unit 40 may allow the fixing jig 22 and the first cutting members 32 to reciprocate. For example, as illustrated in FIG. 5, the first transfer unit 40 may include the first mounting member 42 on which the fixing jig 22 and the first cutting members 32 are mounted and the first transfer member 44 reciprocating to allow the first mounting member 42 to approach the machining target P seated on the seating jig 21 or to be spaced apart from the machining target P.

As illustrated in FIG. 5, the first mounting member 42 has a shape of a plate and is mounted on support columns 16 of the main frame 10 to be slid. A method for mounting the fixing 22 and the first cutting members 32 on the first mounting member 42 is not particularly limited.

For example, the first transfer unit 40 may further include at least one elastic member 46 connecting the first mounting member 42 and the fixing jig 22 to each other and elastically extended and contracted in a reciprocation direction of the fixing jig 22.

Although each of the elastic members 46 may be a compression coil spring elastically extended and contracted in the reciprocation direction of the fixing jig 22, the present disclosure is not limited thereto. The elastic members 46 are provided such that after the fixing jig 22 arrives at a specific pressed portion of the machining target P earlier, the first cutting members 32 arrives at the first scheduled cutting lines E1. The pressed portion refers to the attachment parts A, the inner edge I, and the outer connectors O2 of the skin material S, which are pressed by the above-described fixing parts 25 and 26. As illustrated in FIG. 5, the elastic members 46 have a specific length such that a sum of the height of the elastic member 46 and the height of the fixing jig 22 is larger than the height of the first cutting member 32. Then, as illustrated in FIGS. 7 and 9, the first cutting members 32 may stably cut the outer edges O of the skin material. S along the first scheduled cutting lines E1 in a state in which the pressed portion is elastically pressed by the fixing fix 22 and is fixed in advance.

For example, as illustrated in FIG. 7, opposite ends of the first cutting members 32 may be fixed to the lower surface of the first mounting member 42 such that blades 32*a* provided at ends of the first cutting members 32 face the first scheduled cutting lines E1.

A structure of the first transfer member 44 is not particularly limited. For example, as illustrated in FIG. 5, the first transfer member 44 may be a cylinder device allowing the first mounting member 42 to reciprocate using hydraulic pressure or pneumatic pressure. The first transfer member 44 is coupled to a lower surface of the upper plate 14, and a cylinder rod 44*a* of the first transfer member 44 is coupled to an upper surface of the first mounting member 42. Such a first transfer member 44 may reciprocate to allow the first mounting member 42 to approach the machining target P or to be spaced apart from the machining target P. Then, the fixing jig 22 and the first cutting members 32 may reciprocate to approach the machining target P or to be spaced apart from the machining target P, by the first mounting member 42.

Next, the second transfer unit 50 may allow the second cutting members 34 reciprocate. For example, as illustrated in FIG. 5, the second transfer unit 50 may include the second mounting member 52 on which the second cutting members 34 are mounted and a second transfer member 54 reciprocating to allow the second mounting member 52 to approach the machining target P seated on the seating jig 21 or to be spaced apart from the machining target P.

As illustrated in FIG. 5, the second mounting member 52 has a shape of a plate. A method for mounting the second cutting members 34 on the second mounting member 52 is not particularly limited. For example, as illustrated in FIG. 6, opposite ends of the second cutting members 32 may be fixed to the upper surface of the second mounting member 52 such that blades 34*a* provided at ends of the second cutting members 32 face the second scheduled cutting lines E2.

A structure of the second transfer member 54 is not particularly limited. For example, as illustrated in FIG. 5, the second transfer member 54 may be a cylinder device allowing the second mounting member 52 to reciprocate using hydraulic pressure or pneumatic pressure. A cylinder rod 54*a* of the second transfer member 54 is coupled to a lower surface of the second mounting member 52. Such a second transfer member 54 may reciprocate to allow the second mounting member 52 to approach the machining target P or to be spaced apart from the machining target P. Then, the second cutting members 34 may reciprocate to approach the machining target P or to be spaced apart from the machining target P, by the second mounting member 52.

Next, the cooling unit 60 is provided to cool the machining target P down to a specific temperature. The machining target P is separated from the injection mold while being not cooled and is seated on the seating jig 21, and thus has a high temperature. However, the machining target P having high temperature may be contracted and deformed while being cooled. Because of this, when the machining target P is cut in a high temperature state to have a specific shape, the machining target P is deformed while being cooled, and thus, defective products may be manufactured. To solve this problem, the cutting apparatus 1 may include the cooling unit 60 configured to cool the machining target P.

A structure of the cooling unit 60 is not particularly limited.

For example, the cooling unit 60 may include a blower fan 62 configured to blow air to cool the machining target P. As illustrated in FIG. 5, although the blower fan 62 may be installed to blow air toward the inner edge I of the skin surface S exposed to the outside through a space between the first seating jig 23 and the second seating jig 24 so as to directly cool the machining target P, the present disclosure is not limited thereto. That is, the blower fan 62 may be installed to blow air to at least one of the seating jig 21 and the fixing jig 22 to cool the jig unit 20 so as to indirectly cool the machining target P through the cooled jig unit 20.

For example, the cooling unit 60 may cool the machining target P using cooling water. To achieve this, as illustrated in FIG. 5, the cooling unit 60 may further include at least one cooling water passage 64 formed in at least one of the seating jig 21 and the fixing jig 22 such that the cooling water supplied from an external cooling water supplying device (not illustrated) flows through the cooling water passage 64. Then, the jig unit 20 may be cooled by the cooling water passing through the cooling water passage 64, and the machining target P may be indirectly cooled by the cooled jig unit 20.

Such a cooling unit 60 may cool the machining target P down to the specific temperature while the machining target P is fixed by the jig unit 20. Then, the machining target P may maintain an original shape thereof without deformation while being cooled.

An operation time of the cooling unit 60 is not particularly limited. For example, the cooling unit 60 may be operated to cool the machining target P when the fixing jig 22 arrives as the machining target P earlier than the first cutting members 32 to fix the machining target P. To achieve this, as illustrated in FIG. 7, the first transfer member 44 may wait for a specific cooling time period such that the machining target P may be cooled in a state in which the first cutting members 32 does not arrives at the machining target P, when the fixing jig 22 arrives at the machining target P to fix the machining target P. However, the present disclosure is not limited thereto, and the cooling unit 60 may be operated even after the machining target P is cut by the cutting members 32 and 34.

Figure 11:
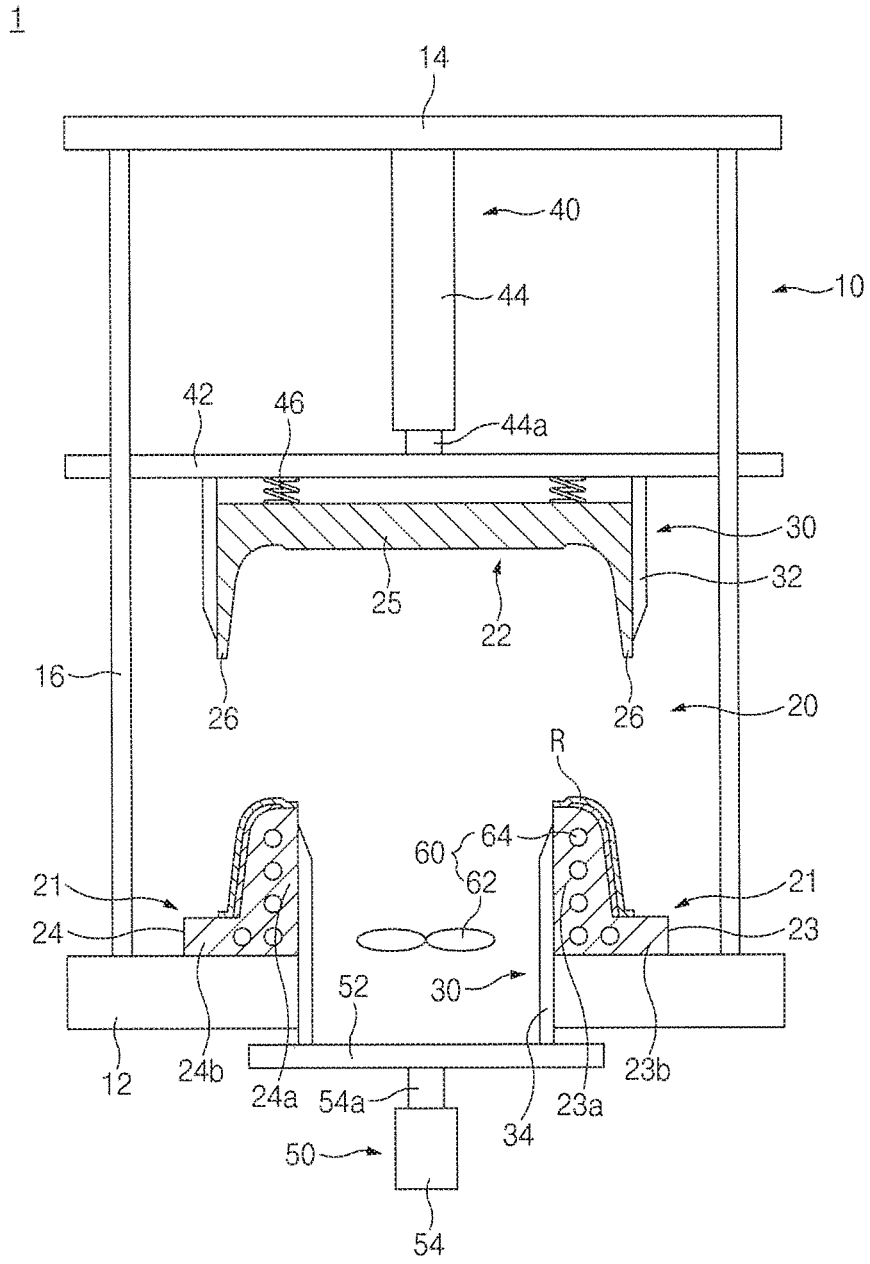
FIG. 11 is a view illustrating a state in which the jig unit of FIG. 1 unfixes the cut machining target.

FIG. 11 is a view illustrating a state in which the jig unit of FIG. 1 unfixes the cut machining target.

Hereinafter, a method for cooling and cutting the machining target P using the cutting apparatus 1 will be described with reference to the accompanying drawings.

First, as illustrated in FIG. 1, the machining target P, which is not cooled after being injection-molded, and thus has high temperature, is seated on a specific seating position of the seating jig 21.

Next, as illustrated in FIG. 5, the first transfer unit 40 is operated such that the fixing jig 22 elastically presses and fixes the specific pressed portion of the machining target P.

Thereafter, the cooling unit 60 is operated to cool the machining target P down to the specific temperature by the air blown by the blower fan 62 and the cooling water flowing through the cooling water passage 64.

Next, as illustrated in FIG. 9, the first transfer unit 40 is operated such that the first cutting members 32 cut the outer edges O of the skin material S along the first scheduled cutting lines E1.

Thereafter, as illustrated in FIG. 10, the second transfer unit 50 is operated such that the second cutting members 34 cut the inner edge I of the skin material S along the second scheduled cutting lines E1.

Next, as illustrated in FIG. 11, the first transfer unit 40 and the second transfer unit 50 are operated such that the fixing jig 22 and the cutting members 32 and 34 are spaced apart from the machining target P to unfix the machining target P.

Thereafter, the cooled and cut machining target P is recovered from the seating jig 21.

According to such a cutting apparatus 1, the injection-molded machining target P may be cut and cooled using the cutting apparatus 1 without cooling the machining target P in the injection mold. In the related art, because the injection-molded machining target should be cooled in the injection mold, the injection molding cannot be performed while the machining target is cooled. In contrast, according to the cutting apparatus 1, after the machining target P may be transferred to the cutting apparatus 1 as soon as the injection molding is completed, the machining target P may be injection-molded. Thus, the cutting apparatus 1 may reduce a manufacturing time period of the machining target P, making it possible to productivity of the machining target P.

Although it has been described that the cutting apparatus 1 cools and cuts the injection-molded machining target P, the present disclosure is not limited thereto. That is, the cutting apparatus 1 may cool and cut the machining target P which is not cooled after being molded in a molding scheme other than the injection molding, and thus has high temperature.

A cutting apparatus according to the present disclosure may perform a cutting process together with cooling of a machining target, so that a manufacturing time of the machining target may be shortened and productivity of the machining target may be improved.

The above description is merely illustrative description of the technical spirit of the present disclosure, and various modifications and deformations may be made by those skilled in the art to which the present disclosure pertains without departing from the essential feature of the present disclosure.

Thus, the embodiments that are disclosed in the present disclosure are not for limiting but for describing the technical spirit of the present disclosure, and the scope of the technical spirit of the present disclosure is not limited by the embodiments. The protection scope of the present disclosure should be interpreted by the appended claims and all the technical spirit corresponding to the equivalents thereof should be interpreted to be included in the scope of a right of the present disclosure.

What is claimed is:

1. A cutting apparatus comprising:

a jig unit having a seating jig on which a machining target is seated and a fixing jig matched with the seating jig to fix the machining target;

a first cutter configured to cut the machining target along first scheduled cutting lines of the machining target;

a first carrier configured to reciprocate to allow the fixing jig to match with the seating jig; and a cooler configured to cool the machining target down to a reference temperature, wherein the first carrier includes:

a mounting plate on which the fixing jig and the first cutter are mounted; and a transfer cylinder configured to reciprocate to allow the mounting plate to approach the machining target or to be spaced apart from the machining target, and wherein the transfer cylinder is configured to position the mounting plate in a fixing position where the fixing jig is in contact with the machining target while the first cutter is spaced apart from and thus is not in contact with the machining target in order to fix the machining target during cooling of the cooler without cutting the machining target.

2. The cutting apparatus of claim 1, wherein the fixing jig selectively presses a reference pressed area of the machining target such that the first scheduled cutting lines are exposed to an outside of the jig unit.

3. The cutting apparatus of claim 1, wherein the first carrier further includes:

elastic members connecting the jig unit and the mounting plate, the elastic members elastically extending and contracting in a reciprocation direction of the fixing jig.

4. The cutting apparatus of claim 3, wherein the elastic members have a reference length such that the first cutters reach the first scheduled cutting lines after the fixing jig reaches the pressed area.

5. The cutting apparatus of claim 3, wherein the elastic members include compression coil springs elastically extending and contracting in the reciprocation direction of the fixing jig.

6. The cutting apparatus of claim 1, further comprising: a second cutter configured to cut the machining target along reference second scheduled cutting lines, wherein the seating jig includes:

a first seating jig on which a portion of the machining target is seated; and a second seating jig on which another portion of the machining target is seated, wherein the first seating jig and the second seating jig are spaced apart from each other by a reference interval such that the second scheduled cutting lines of the machining target are exposed to an outside of the jig unit through a space between the first seating jig and the second seating jig.

7. The cutting apparatus of claim 6, further comprising:

a second carrier reciprocating to allow the second cutter to approach the machining target or to be spaced apart from the machining target, through the space between the first seating jig and the second seating jig.

8. The cutting apparatus of claim 6, wherein the cooler includes:

a blower fan configured to blow air to the machining target through the space between the first seating jig and the second seating jig.

9. The cutting apparatus of claim 1, wherein the cooler cools at least one of the seating jig and the fixing jig to indirectly cool the machining target.

10. The cutting apparatus of claim 9, wherein the cooler includes:

a blower fan configured to blow air to at least one of the seating jig and the fixing jig.

11. The cutting apparatus of claim 1, wherein the cooler has a cooling water passage formed in at least one of the seating jig and the fixing jig such that externally supplied cooling water flows through the cooling water passage.

12. The cutting apparatus of claim 1, wherein the first carrier reciprocates to allow the fixing jig to be spaced apart from the seating jig.

* * * * *